United States Patent [19]

Patel

[11] 4,189,317

[45] * Feb. 19, 1980

[54] FLAME SPRAY POWDER MIX

[75] Inventor: Mahesh S. Patel, Albertson, N.Y.

[73] Assignee: Eutectic Corporation, Flushing, N.Y.

[ * ] Notice: The portion of the term of this patent subsequent to Aug. 2, 1994, has been disclaimed.

[21] Appl. No.: 915,939

[22] Filed: Jun. 15, 1978

[51] Int. Cl.[2] ..... B05D 1/08

[52] U.S. Cl. ..... 75/252; 75/255; 427/423; 428/937

[58] Field of Search ..... 427/423; 428/937; 75/252, 255, 0.5 R

[56] References Cited

U.S. PATENT DOCUMENTS

| | | | |
|---|---|---|---|
| 3,313,633 | 4/1967 | Longo | 428/937 |
| 4,039,318 | 8/1977 | Patel | 428/937 |
| 4,118,527 | 10/1978 | Patel | 428/678 |

*Primary Examiner*—Arthur J. Steiner

*Attorney, Agent, or Firm*—Hopgood, Calimafde, Kalil, Blaustein and Lieberman

[57] ABSTRACT

A flame spray powder mix is provided for producing metal coatings on metal substrates, such as ferrous metal substrates, e.g., steel, case iron, among other metal substrates, the powder mix comprising particles of at least one metal silicide, e.g., titanium disilicide, mixed with a coating metal powder, such as nickel powder. The amount of metal silicide in the powder mix preferably ranging from about 2% to 20% by weight.

9 Claims, 4 Drawing Figures

X 160

X 160

X 160

FLAME SPRAY POWDER MIX

This invention relates to a flame spray powder mix or blend and, in particular, to a flame spray powder mix constituted of at least one metal silicide mixed with a coating metal powder, the mix being characterized when flame sprayed onto a metal substrate of providing an adherent bond coat exhibiting improved bond strength and capable of adhering to a subsequently applied overlay coating of substantial thickness.

STATE OF THE ART

It is known to coat metal substrates with a flame spray material to protect said metal substrates, such as a ferrous metal substrate, including steel and the like, and impart thereto improved properties, such as resistance to corrosion, and/or oxidation, and/or wear and the like. The metal sprayed may be in the form of a wire or a powder, powder spraying being a preferred method.

In order to provide a metal substrate with an adherent coating, it is the practice to clean the substrate and shot blast it with steel grit or thread the surface thereof on a lathe, if the shape is cylindrical, before depositing the metal coating thereon.

In U.S. Pat. No. 3,322,515, a method is disclosed for providing an adherent coating onto a metal substrate by first cleaning the substrate and flame spraying a metal bond coat thereon using a flame spray powder in which elemental nickel and aluminum are combined together to form a composite particle. This type of powder which is referred to in the trade as bond coat powder provides a basis layer by means of which a sprayed overlayer of other metals and alloys of substantial thickness is adherently bonded to the metal substrate. With this technique, fairly thick overlayers can be produced.

The patent also states that ceramic deposits can be produced by mixing a ceramic with the nickel-aluminum composite powder, for example, 60% by weight of ceramic. Examples of ceramics are $Al_2O_3$ and carbides and silicides or Cr, Mo, W and other refractory metals.

It is known that heated aluminum powder reacts exothermically with air to release a large amount of heat. It is believed that this mechanism is responsible in large part for the production of an adherent bond using nickel-aluminum powder in which fine aluminum powder is resin-bonded to a nickel core particle. The bond coat generally ranges in thickness from about 0.004 to 0.01 inch, as thicker coatings do not have satisfactory properties. It is also known to produce coatings of self-fluxing alloys, such as self-fluxing nickel-base alloys, in which aluminum powder is simply mixed with the nickel-base powder and sprayed to produce a dense hard coating, reference being made to U.S. Pat. No. 4,031,278.

The bond coat produced from nickel-aluminum composite powder has not been adequate as a final coat due to its poor machinability. Moreover, it is difficult to obtain thick coatings of good quality as generally the thicker the sprayed coating, the more powdery is the deposit. Such deposit is not conducive for providing a smooth surface finish by grinding or turning in a lathe and thus this method has not been useful as a one-step coating technique.

One proposal for overcoming the foregoing problem and of providing a one-step bond coating is disclosed in U.S. Pat. No. 3,841,901. In this patent, it is proposed to add metallic molybdenum to the nickel-aluminum composite powder system or similar system (e.g., copper-aluminum, iron-aluminum or even the nickel-copper-aluminum system), the amount of aluminum ranging from about 2% to 18% and molybdenum from about 0.5 to 16% by weight. The patent states that the addition of molybdenum as a constituent of the composite particle enables the production of a one-step nickel-aluminum-molybdenum coating of thickness, e.g., 0.03 to 0.05 inch, capable of providing a machined surface of good quality.

However, one of the disadvantages of using molybdenum is that, during flame spraying, molybdenum tends to produce smoke, especially in the upper range of composition.

In U.S. Pat. No. 4,039,318, a metaliferous flame spray material is disclosed, formed of a plurality of ingredients physically combined together in the form of an agglomerate, the plurality of ingredients in the agglomerate comprising by weight of about 3% to 15% aluminum, about 2 to 15% refractory metal silicide and the balance of the agglomerate essentially a metal selected from the group consisting of nickel-base, cobalt-base, iron-base and copper-base metals. A preferred combination in the patent is at least one refractory metal disilicide, e.g. $TiSi_2$, agglomerated with aluminum and nickel powder.

The foregoing combination of ingredients provides coatings having improved bond strength and improved machinability.

A common ingredient in all of the foregoing agglomerated powders of the prior art is aluminum. While the presence of aluminum in the agglomerate is believed to be beneficial for improving bond strength, it has been noted that the bond coat produced tends to have a dispersion of oxide therein which hardens the coating. In the case of a nickel bond coat, the coating is generally characterized by a fine oxide dispersion. It is believed that, because the aluminum and nickel are intimately combined in the agglomerate, the violent oxidation of aluminum during flame spraying causes a rushing in of air during spraying which results in a coating containing dispersed oxides. Whatever the theory, the tendency is to form a metal coating with substantial amounts of oxides inclusions dispersed therein.

The presence of fine oxides in the coating tends adversely to affect the ductility of the bond coat. A ductile bond coat is desirable in that it has a greater resistance to fretting or spalling. Moreover, an applied overcoat to the bond coat will tend to resist spalling better where the underlying bond coat is ductile and thus capable of withstanding thermal stresses better. The ductility of the bond coat is generally indicated by its hardness. Thus, the softer the coating, the greater is the tendency for it to be more ductile.

It would thus be desirable to provide an improved coating system capable of producing an adherent layer of substantial thickness which is ductile and which is low in dispersed oxides.

OBJECTS OF THE INVENTION

It is thus an object of the invention to provide a method for producing an adherent coating on a metal substrate having improved bond strength.

Another object is to provide a flame spray powder mix comprising at least one metal silicide mixed with a coating metal making up substantially the balance of the mixture.

A further object is to provide an improved flame spray method.

These and other objects will more clearly appear from the following disclosure and the accompanying drawing, wherein.

SUMMARY OF THE INVENTION

Figure 1:
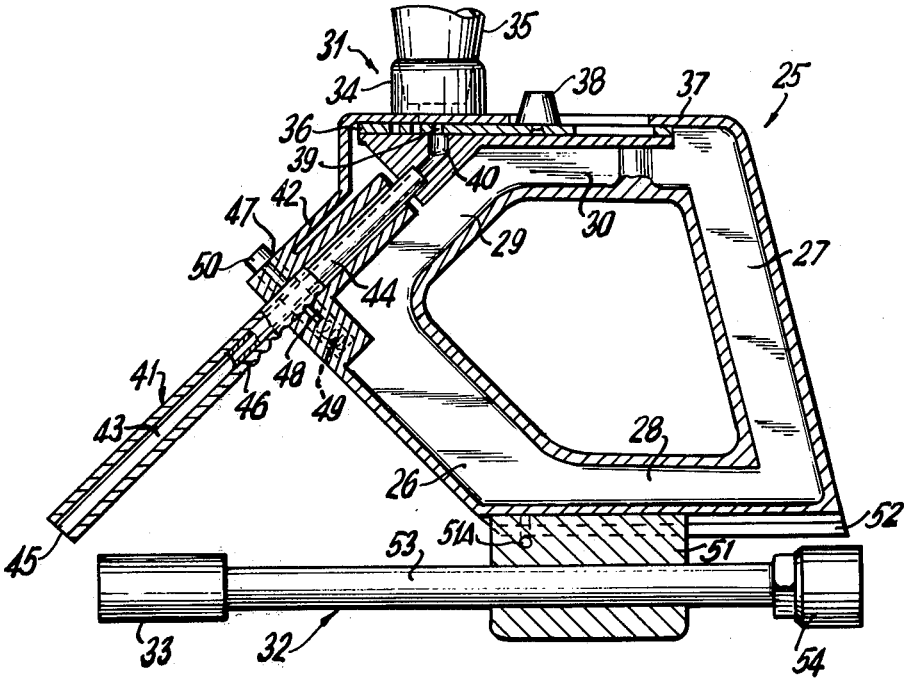
FIG. 1 is an illustration of one type of a flame spray torch which may be employed to spray the powder mix of the invention.

One embodiment of the invention is directed to a flame spray powder mix or blend formed of a mere mixture of particles of metal silicide with a coating metal powder, the average size of said metal silicide ranging from about 10 to 150 microns and said coating metal powder ranging from about 30 to 140 microns, preferably from about 40 to 75 microns. It is important to control the average size of the metal silicide over the foregoing ranges in order to assure good flow characteristics.

The term "average size" applied to the metal silicide powder means that the average size of the total powder ranges from about 10 to 150 microns, with part of the powder falling outside the range so long as the average size of the powder as a whole will have substantially the foregoing average size. Thus, for example, the metal silicide may range in size from to about 10% to 20% by weight in the range of about minus 80 to plus 325 mesh (minus 177 microns to plus 44 microns) with the balance below 325 mesh (below 44 microns), the average size as stated above ranging from about 10 to 150 microns, e.g., about 10 to 75 microns. The same applies to the average size of the coating metal powder, so long as it ranges from about 30 to 140 microns.

The composition of the powder mix with respect to the metal silicide content may vary by weight from about 2% to 20% metal silicide, with substantially the balance the coating metal.

In another embodiment, the powder mix or blend may also contain silicon powder. Thus, the mixture may comprise at least one metal silicide, some silicon and particles of the coating metal, the composition of the mixture ranging by weight from about 2% to 20% metal silicide (e.g., 2% to 15%), 0 to 15% silicon (e.g., 1% to 10%), and the balance essentially the coating metal powder.

Metal disilicides are preferred, such as disilicides of Ti, Zr, Hf, V, Nb, Ta, Cr, W, Mn and Co. Boron silicide and magnesium silicide may also be employed. The coating metal mixed with the metal silicide may be at least one metal from the group consisting of Ni, Co, Fe, Cu, nickel-base, cobalt-base, iron-base, copper-base alloys and aluminum bronze.

The powder mixture of the invention differs from the composite agglomerate of the prior art in that the metal silicide is not combined with the coating metal in the agglomerate but is simply a mixture of the metal silicide with the coating metal.

Tests have shown that a system comprised of $TiSi_2$-Ni in the form of a simple powder mix containing 5% $TiSi_2$ and the balance nickel when sprayed onto a steel substrate provided a good bond strength of about 2,530 psi (lbs/sq. in.). The foregoing compared favorably with the bond strength obtainable with a nickel-aluminum agglomerate (about 2515 psi) in which both the nickel and aluminum particles are agglomerated together. In addition, a cleaner bond coat is obtained with the powder composition of the invention.

An advantage of using metal silicide without aluminum in the agglomerate is that a narrow spray cone is obtained which provides better control of the flame spray reaction and greater heat concentration with the narrow cone where it is needed in the area being sprayed. The presence of aluminum tends to give a broader cone (an "overspray" cone configuration) in which the heat is not fully utilized where it is needed.

The metal silicide system appears to work on a controlled oxidation-reduction principle in contrast to when aluminum is present. With aluminum and nickel intimately agglomerated together, a vigorous oxidation reaction occurs wherein the coating produced has dispersed oxides. On the other hand, the flame spray powder of the invention results in a much cleaner coating.

When nickel is the coating metal mixed with the metal silicide, e.g., $TiSi_2$, the nickel deposited is very clean and exhibits a very low hardness of about 11 to 20 $R_B$ as compared to the powder mix using aluminum intimately combined with the nickel as an agglomerate in which the nickel coating produced contains a dispersion of oxides and has a hardness of about 50 to 65 $R_B$. A coating with dispersed oxides is also produced with a powder mix in which titanium disilicide, aluminum and nickel are intimately agglomerated together.

The flame spray powder mix or blend provided by the invention enables the production of a single bond coat capable of being machined to a good finish. The bond coat also enables the buildup of a top coat thereon of substantial thickness which adheres strongly to the bond coat. The powder mix may be sprayed using various types of metal spray torches well known in the art, particularly oxyacetylene torches. However, plasma spray torches may also be employed. Thus, the term "flame spray" used herein is meant to cover the foregoing types of torches in which the powder mix is injected into the flame, be it an oxyacetylene flame or a plasma flame, and the heated powder then applied to the metal substrate.

A preferred torch is that disclosed in U.S. Pat. No. 3,620,454 which is adapted for gravity feed of the powder externally to the flame issuing from a nozzle, the torch being depicted in FIG. 1.

DETAILS OF THE INVENTION

The powder mix of the invention enables the production of a one-step coating of substantial thickness ranging up to about 0.25 inch, for example, about 0.01 to 0.125 inch. Good bonding strengths are obtained. The bond coat which tends to be soft and ductile serves as an excellent base for the application of a top coat, such as a top coat of a nickel-base self-fluxing alloy or other alloy coatings of substantial thickness ranging up to about 0.25 inch.

As stated hereinbefore, while various flame spray torches may be employed for producing the coating on a metal substrate, a preferred torch is that shown in FIG. 1.

The flame spray torch 25 shown may be adapted for gravity feed of flame spray powder directly to the flame issuing from the nozzle as shown, or the powder feed may be automated by injection with a carrier gas under pressure (e.g., such as argon) from a powder feed unit.

The torch has a housing in the shape of a five sided polygon with one leg of the polygon arranged as a handle portion 27, another leg as a base portion 28, a further leg as a feed portion 29, and another leg 30 of the polygon as the top portion of the torch. The housing 26 has coupled to it a powder feed assembly 31 and a flame assembly 32 to which is coupled nozzle 33.

The top leg portion 30 is provided with a fitting 34 adapted to receive a receptable 35 (shown fragmentarily) for holding the flame spray powder, a metering device being employed to control powder feed comprising a feed actuator plate 36 slidably mounted in a slot 37 located in the housing top portion 30 below fitting 34. Feed plate 36 is provided with a knob 38 which protrudes upwardly above the housing and permits the sliding of feed plate 36 reciprocally toward and away from housing feed portion 29.

The powder mix flows by gravity unhindered through circular orifices which may range in size from 0.075 to 0.120 inch for different powders, the flow being maintained substantially constant over a mesh size range of minus 100 to plus 325 mesh.

In achieving the desired flow rate, feed plate 36 is selectively aligned with powder flow orifice 39 to control variably the flow rate of the powder from receptable 35 through flow orifice 39 through conduit 40 and through variable spray control assembly 41. Assembly 41 has a housing 42 which holds a powder feed tube 43 and having a central core hollow cylinder 44 slidably and telescopically fitted within feed tube 43 and communicating directly with powder flow conduit 40 to deliver powder directly by gravity to feed tube 43, the powder then flowing through discharge end 45. A portion of the outer surface of feed tube 43 is provided with indexing means or grooves 46 which through latching assembly 47 enables the setting of powder feed tube 43 in order to locate discharge end 45 at the correct distance from the flame end of nozzle 33. The latching assembly comprises a holding pin 48 that is normally urged toward one of the indexing grooves 46 by spring 49, the holding pin 48 being actuated by rod 50 in making the setting. Thus, by depressing rod 50, the pin is moved out of contact with one of the indexing grooves and tube 43 set according to the desired position.

The flame assembly 32 is supported by sliding element 51 which can be lockingly moved along a track 52 located at the bottom leg 28 of housing 26, a locking pin 51A being provided as shown. Gas flow tube 53 is fixedly held by sliding element 51 and may be factory set, one end of the tube having a connector 54 for attaching to a source of oxygen and acetylene.

The powder flows down tube 43 and is discharged at 45 into the flame issuing from nozzle 43. The powder is sprayed on a metal substrate, e.g., a steel shaft, at about six to eight inches from the workpiece.

The powder mix or blend for spraying may be produced by conventional mixing. One type of blender found useful for this purpose is one comprising a double cone construction referred to in the trade by the designation ROTA-CLONE manufactured by the Abbe Engineering Company of Brooklyn, N.Y.

Good bonding results have been obtained with many metal silicide systems, particularly with refractory metal disilicides, such as the following: $TiSi_2$, $ZrSi_2$, $HfSi_2$, $NbSi_2$, $VSi_2$, $TaSI_2$, $CrSi_2$, $WSi_2$, $MnSi_2$, among others.

The bond strength is determined according to ASTM designation C633-69. The determination is made by using a set of two cylindrical blocks one inch in diameter and one inch long. An end face of each block of the set is ground smooth and one face coated with the aforementioned bond coat compositions by flame spraying to a thickness of about 0.005 to 0.01 inch. A high strength overcoat is applied to the bond coat, the high strength overcoat being a nickel-base alloy known by the trademark Inconel (7% Fe-15% Cr-balance Ni) which has a bond strength of over 10,000 psi, that is, much higher than the bond coat being tested. The thickness of the high strength overcoat is about 0.015 inch and after depositing it, the overall coating which ranges up to about 0.025 inch is then finished ground to about 0.015 inch. A layer of epoxy resin is applied to the overcoat layer, the epoxy layer having a bond strength of over 10,000 psi.

The other block of the set is similarly end ground and a layer of high strength epoxy resin applied to it. The two blocks of the set, one with the metal coating and the epoxy layer, are clamped together with the epoxy faces of the blocks in abutting contact and the clamped blocks subjected to heating in an oven to 300° F. (150° C.) for one hour, whereby the epoxy faces strongly adhere one to the other to provide a strongly bonded joint.

The joined blocks are then pulled apart using anchoring bolts coaxially mounted on opposite ends of the joined blocks using a tensile testing machine for recording the breaking force. The bonding strength is then determined by dividing the force obtained at failure by the area of the one inch circular face of the blocks.

In producing the sprayed coating, the powder composition is sprayed on a clean ferrous metal substrate, e.g., a 1020 steel strip, using an oxyacetylene gravity feed torch of the type shown in FIG. 1. The steel is then bent to determine by observation the extent of the bonding. However, in determining the actual bond strength of the coating, the method described herein under ASTM designation C633-69 is employed.

As illustrative of the various embodiments of the invention, the following example is given.

EXAMPLE

A series of tests were conducted in which nickel powder of average size ranging from about 40 to 75 microns (−200+325 mesh) was blended with various metal silicides. The blended powders were then sprayed on test blocks in accordance with ASTM C633-69 and the bond strength obtained for each powder blend. The blended powders were sprayed using the oxyacetylene torch of FIG. 1. The torch was held a distance of about 5 to 7 inches from the surface. The following results were obtained:

| Test No. | Material | % by Wt. | Average Size (Microns) | Average Bond Strength (psi) |
|---|---|---|---|---|
| (1) | $CrSi_2$ | 3.5 | 25 | 2150 |
| (2) | $CrSi_2$ | 8.0 | 25 | 2490 |
| (3) | $TiSi_2$ | 3.0 | 25 | 2532 |
| (4) | $VSi_2$ | 5.0 | 30 | 2436 |
| (5) | $TaSi_2$ | 6.0 | 20 | 1720 |

-continued

| Test No. | Material | % by Wt. | Average Size (Microns) | Average Bond Strength (psi) |
|---|---|---|---|---|
| (6) | $NbSi_2$ | 5.0 | 23 | 2086 |
| (7) | $MnSi_2$ | 5.0 | 23 | 2213 |
| (8) | $WSi_2$ | 5.0 | 35 | 2389 |
| (9) | $TiSi_2$ | 5.0 | 40 | 2531 |
| (10) | $TiSi_2$ | 6.0 | 40 | 2420 |
| (11) | $TiSi_2$ | 7.0 | 40 | 2787 |
| (12) | $TiSi_2$ | 8.0 | 40 | 2525 |
| (13) | $TiSi_2$ | 10.0 | 40 | 2214 |
| (14) | $TiSi_2$ | 11.0 | 40 | 1831 |
| (15) | $TiSi_2$ | 12.0 | 40 | 3100 |
| (A) | 5% Al-95% Ni (Agglom.) | | 40–75 | 2515 |
| (B) | 4% $TiSi_2$ + 6% Al + 90% Ni (Agglom.) | | 40–75 | 3300 |

The failure in each of the test samples occurred within the bond. It was observed that the sprayed powder produced substantially 100% bonding. The bond strength of the silicide powder blends were generally comparable to the agglomerated aluminum plus nickel powder. However, the bonded layers produced by the invention were cleaner and softer than the bonded layers produced in Test Nos. A and B. This will be clearly apparent by comparing the photomicrograph of FIG. 2 of the invention with the photomicrograph of FIGS. 3 and 4 outside the invention, the coating shown in FIG. 3 being produced from agglomerated $TiSi_2$+Al+Ni and FIG. 4 from agglomerated Ni+Al.

Figure 2:
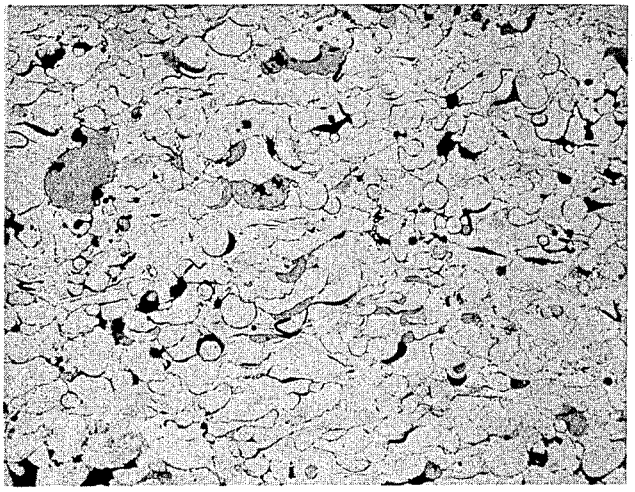
FIG. 2 is a representation of a photomicrograph taken at 160 times magnification of a cross section of a sprayed coating produced in accordance with one embodiment of the invention.
Figure 3:
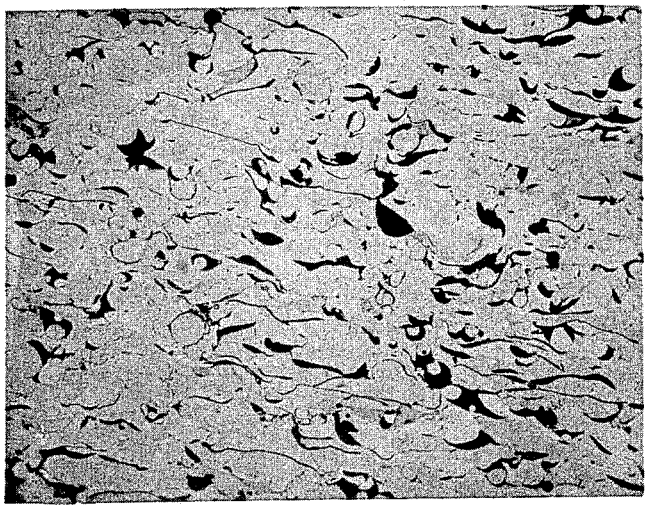
FIG. 3 is a representation of a photomicrograph taken at 160 times magnification produced from a powder agglomerate containing titanium disilicide, aluminum and nickel.
Figure 4:
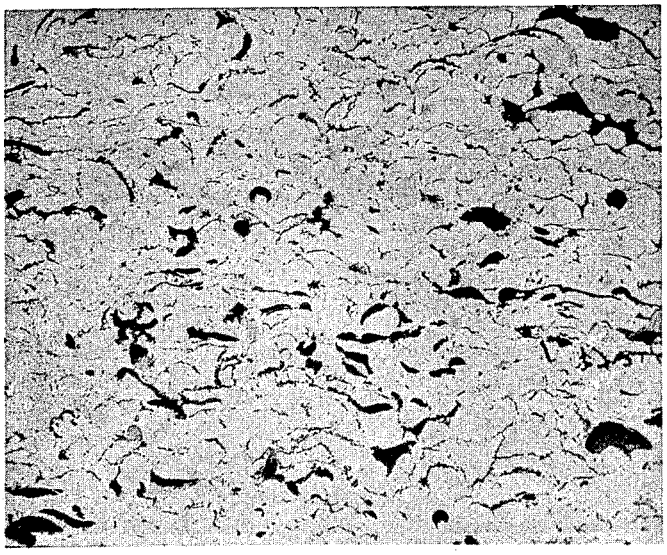
FIG. 4 is a representation of a photomicrograph taken of a cross section of a sprayed coating taken at 160 times magnification produced from a powder agglomerate containing nickel and aluminum.

Both of the coatings of FIGS. 3 and 4 show dispersions of oxides, while the coating of FIG. 2 appears much cleaner. In addition, the coating of FIG. 2 was softer and more ductile, with the hardness ranging from about 11 to 20 $R_B$, the hardness of the coatings shown in FIGS. 3 and 4 ranging generally from about 50 to 65 $R_B$.

As stated hereinbefore, the invention may also be employed for applying such coating metals as nickel-base, cobalt-base, iron-base, copper-base alloys and aluminum bronze, as well as for applying nickel, cobalt, iron and copper per se.

The preferred alloys are those which are self-fluxing and having a melting point ranging from about 870° C. to 1288° C. (1600° F. to 2350° F.), it being understood, however, that the alloys need not be self-fluxing. The self-fluxing alloys include those containing at least one of the metals selected from the group consisting of about 0.5% to 6% of silicon and 0.5% to 5% boron.

Examples of such alloys are given as follows:

NICKEL-BASE MATRIX ALLOY

| Constituent | Range in Percent By Weight | Example |
|---|---|---|
| Silicon | 1.5–5.0 | 3.0 |
| Boron | 1.5–5.0 | 2.0 |
| Chromium | 0–20 | 1.0 |
| Molybdenum | 0–7 | 0.2 |
| Nickel | (1) | (1) |

(1)Essentially the balance.

The above alloy may be substituted in nickel content by cobalt or iron. Also, alloys of this type can consist of a matrix containing refractory carbide particles (e.g. WC) in a fine particle size to effect a further improvement in abrasion resistance. The following matrix alloy may be employed.

COBALT-BASE MATRIX ALLOY

| Constituent | Range in Percent By Weight | Example |
|---|---|---|
| Nickel | 1.–5.0 | 3.0 |
| Chromium | 20.0–32.0 | 28.0 |
| Silicon | 0.5–3.0 | 1.0 |
| Boron | 1.0–3.0 | 2.0 |
| Carbon | 0.8–2.0 | 1.0 |
| Tungsten | 3.5–7.5 | 4.5 |
| Molybdenum | 0.0–5.0 | 3.0 |
| Cobalt | (1) | 57.5 |

(1)Essentially the Balance.

Again, nickel or iron may be substituted in the above formulation for a like amount of cobalt.

A particularly preferred copper-base matrix alloy which has been found useful has the following constituents in percentages by weight as indicated:

COPPER-BASE ALLOY

| Constituent | Broad Range | Intermediate Range |
|---|---|---|
| Nickel | 15.0–40.0 | 20–25 |
| Silicon | 1.0–5.0 | 3.0–4.0 |
| Boron | 0.15–2.50 | 0.25–0.5 |
| Manganese | 0.20–2.00 | 0.5–1.0 |
| Copper | (1) | (1) |

(1)Essentially the Balance.

As an example of a matrix alloy within the above ranges, there may be mentioned:

| Constituents | Percent by Weight |
|---|---|
| Nickel | 23.00 |
| Silicon | 3.45 |
| Boron | 0.47 |
| Manganese | 0.75 |
| Copper | (1) |

(1)Essentially the Balance.

The foregoing alloys are preferably employed as atomized powders. A particular nickel-base alloy is one containing about 3% Si, 2% B, 1% Cr, 0.2% Mo and the balance essentially nickel. It is preferred that the above size of the coating metal range from minus 200 mesh to plus 325 mesh; that is from about 40 to 75 microns.

As-sprayed coatings of substantial thickness may be produced in accordance with the invention, e.g., coating thicknesses of up to about 0.25 inch, e.g., about 0.01 to 0.125 inch. The fact that disilicides may be employed to produce the coating does not mean that only disilicides will be present. For example, the spraying of powder containing $TiSi_2$ has resulted in a coating with $TiSi_2$, $Ti_5Si_3$, etc., being present. Likewise, a powder containing $CrSi_2$ has resulted in a coating containing CrSi. Generally speaking, the final coating will contain less than 15% by weight of refractory metal silicide (e.g., silicides of Ti, Zr, Hf, V, Nb, Ta, Cr, and W) and generally less than about 10% by weight. The isolated gray areas shown in FIG. 2 are silicides. Although there are some black oxides present, they are substantially less than in FIGS. 3 and 4.

When the sprayed metal coating of the invention has shown particular applicability to ferrous metal substrates, the sprayed metal coating is also compatible with metal substrates comprising nickel, cobalt, aluminum-base alloys and copper-base substrates, among other compatible metal substrates.

Although the present invention has been described in conjunction with preferred embodiments, it is to be understood that modifications and variations thereto may be resorted to without departing from the spirit and scope of the invention as those skilled in the art will readily understand. Such modifications and variations are considered to be within the purview and scope of the invention and the appended claims.

What is claimed is:

1. A flame spray powder mixture consisting essentially of a metal silicide and a coating metal powder, said metal silicide being at least one silicide selected from the group consisting of disilicides of Ti, Zr, Hf, V, Nb, Ta, Cr, W, Mn and Co, and magnesium silicide and boron silicide, said metal silicide having an average size ranging from about 10 to 150 microns, the average size of said coating metal powder ranging from about 30 to 140 microns, the composition of said powder mix ranging from about 2% to 20% by weight of said silicide, with substantially the balance said coating metal powder.

2. The flame spray powder mix of claim 1, wherein said mix also contains silicon particles in an amount ranging up to about 15% by weight of the total mix, the average size of said silicon ranging from about 10 to 150 microns.

3. The flame spray powder mix of claim 1, wherein the amount of said silicide ranges from about 2% to 15% by weight of the mixture.

4. The flame spray powder mix of claim 2, wherein the amount of said silicon ranges from about 1% to 10% by weight of the total mix.

5. The flame spray powder mix of claim 1, wherein the coating metal powder is selected from the group consisting of Ni, Co, Fe, Cu, nickel-base, cobalt-base, iron-base, copper-base alloys and aluminum bronze.

6. A flame spray powder mix formed of a titanium disilicide powder mixed with nickel powder.

the average size of said titanium silicide powder ranging from about 10 to 150 microns and said nickel powder ranging from about 30 to 140 microns, the composition of said powder mix ranging from about 2% to 20% by weight of said titanium disilicide, with substantially the balance of said mix nickel powder.

7. The flame spray powder mix of claim 6, wherein said mix also contains silicon particles in an amount ranging up to about 15% by weight of the total mix.

8. The flame spray powder mix of claim 6, wherein the amount of titanium disilicide ranges from about 2% to 15% by weight of the mix, and wherein the average size ranges from about 10 to 75 microns.

9. The flame spray powder mix of claim 7, wherein the amount of said silicon ranges from about 1% to 10% by weight of the total mix.

* * * * *